United States Patent [19]

Madaffari

[11] Patent Number: 4,815,560

[45] Date of Patent: Mar. 28, 1989

[54] MICROPHONE WITH FREQUENCY PRE-EMPHASIS

[75] Inventor: Peter L. Madaffari, Elgin, Ill.

[73] Assignee: Industrial Research Products, Inc., Elk Grove Village, Ill.

[21] Appl. No.: 128,736

[22] Filed: Dec. 4, 1987

[51] Int. Cl.[4] ..... G10K 13/00; H04R 1/02; H04R 25/00

[52] U.S. Cl. ..... 181/158; 181/129; 181/130; 181/163; 181/166; 381/68.6; 381/69; 381/158; 381/159; 381/182

[58] Field of Search ..... 181/129, 130, 158, 160, 181/166, 171, 163; 381/68.2, 68.6, 69, 153, 158, 188, 191, 159, 182

[56] References Cited

U.S. PATENT DOCUMENTS

| | | | |
|---|---|---|---|
| 3,963,881 | 6/1976 | Fraim et al. | 381/191 X |
| 4,063,050 | 12/1977 | Carlson et al. | 381/191 X |
| 4,450,930 | 5/1984 | Killion | 181/158 |
| 4,504,703 | 3/1985 | Schneiter et al. | 381/191 X |

*Primary Examiner*—B. R. Fuller

*Attorney, Agent, or Firm*—Wallenstein, Wagner, Hattis & Strampel

[57] ABSTRACT

A stepped frequency microphone particularly adapted to a hearing aid application provides a stepped frequency response characteristic relative to frequency, and has a low-pass sonic attenuator for providing to the undriven side of the microphone diaphragm a sonic counterpressure which at low frequencies substantially cancels ambient sound pressure delivered to the drive side of the diaphragm, the attenuator reducing this counterpressure at elevated frequencies to provide accentuated high frequency response.

8 Claims, 2 Drawing Sheets

MICROPHONE WITH FREQUENCY PRE-EMPHASIS

DESCRIPTION

1. Technical Field

The technical field of the invention is electrical transducers and in particular miniature electrical microphones for hearing aids.

2. Background Art

The present invention is an improvement on U.S. Pat. No. 4,450,930 entitled "Microphone with Stepped Response" issued to Mead C. Killion. The Killion patent describes an acoustic network whose function is to provide, when incorporated into a microphone, the transduction of sound to an electrical output wherein the higher frequencies have a greater signal level with respect to the lower frequencies. The benefits of such selective adjustment of signal according to frequency for the hearing impaired is described therein.

The Killion patent describes a microphone assembly wherein a housing having a cavity is separated into two principal chambers by a main diaphragm, and further including a microphone transducer element disposed to be actuated by movement of this main diaphragm. Ambient sound is spit at an input port so that a fraction of the sound enters one of the chambers without significant attenuation. The remainder of the incoming sound is passed through a series of relatively short passages and apertures to enter a sealed chamber having a secondary diaphragm forming one wall thereof. Sound entering this second branch ultimately passes through the flexing of this secondary diaphragm to the opposite side of the main diaphragm.

The compliance and mass of the secondary diaphragm, and the dimensions of the passages are chosen so that at relatively low frequency there is relatively little acoustical attenuation in this second branch, with the result that a significant pressure cancellation occurs at the main diaphragm so as to suppress the microphone response at these lower frequencies. At higher frequencies the attenuation in this second branch becomes substantially greater, resulting in a significant reduction of the counterpressure produced by the secondary diaphragm, resulting in substantially increased high frequency output.

The stepped response microphone described in the Killion patent provided the necessary frequency variation of a response, but required in the smallest embodiment an overall case dimension of approximately 4.0 by 5.6 by 2.3 millimeters.

Attempts to further miniaturize microphones of this general design proved unsuccessful beyond a certain limit, principally because of the fact that the relatively short sound-attenuating passages of the second acoustical branch referred to above could not be correspondingly shortened while still providing the desired resonance turnover point, namely a point in the vicinity of 1 kilohertz.

Thus, prior to the instant invention, there remained a need for a microphone providing the general frequency characteristics of the Killion design, while overcoming the above-mentioned disadvantage thereof.

SUMMARY OF THE INVENTION

The present invention is an improvement over the above-mentioned frequency dependent acoustic attenuating network. In the present design only one inlet is required to the microphone case instead of the two necessary in this previous design, thus reducing the necessity for a perfect seal around the sound inlet. It also allows the use of a reduced dimension inlet tube, unlike previous designs wherein the inlet tube diameter and tube flange were necessarily of increased size to feed the second inlet. The present invention is an improvement over the acoustical network in the above-cited patent in that the present design can achieve the same frequency response in a physically smaller unit.

According to a feature of the invention, the secondary diaphragm is disposed to confront the transducer main diaphragm, separating the case into two principal volumes. Ambient sound is admitted to the chamber formed between the two diaphragms, this structure acting as a distributed line rather than a lumped element to provide the acoustic inertia required for the stepped response shape. The structure used is effectively three dimensional rather than two dimensional, and more efficiently uses the reduced volume of a smaller transducer.

According to a related feature of this invention, the principal acoustic structure which provides the stepped response shape lies on the side of the transducer diaphragm opposite the electrical amplifier and connecting circuitry. This placement of the acoustic structure, as opposed to other designs which attempted to adapt U.S. Pat. No. 4,450,930 to systems of reduced dimensions, allows the step in amplitude to occur at the proper frequency of one kilohertz. By means of a unique bypass element around the main transducer diaphragm, the present invention achieves additional high acoustic inertia, while trapping a majority of the volume between the main diaphragm and secondary diaphragm. The placement of the acoustic network in an area other than the rear cover allows this surface to be non-planar, thus freeing this area for other uses such as a support for terminal pads, which further reduces the volume of the microphone.

According to a further feature of the invention, additional acoustical inertia (inertance) is provided in series with the secondary diaphragm to further lower the turnover frequency by sealingly interposing a labyrinth plate between the two diaphragms, the plate having a suitably dimensioned passage coupling sound between the two chambers thus formed. Ambient sound is restricted to enter the chamber formed between the labyrinth plate and the main diaphragm, to pass across this chamber to pass through the labyrinth plate passage, and thereafter to reverse direction to flow across the secondary diaphragm. This increased path length thus additionally contributes to the necessary total inertance.

DETAILED DESCRIPTION

Figure 1B:
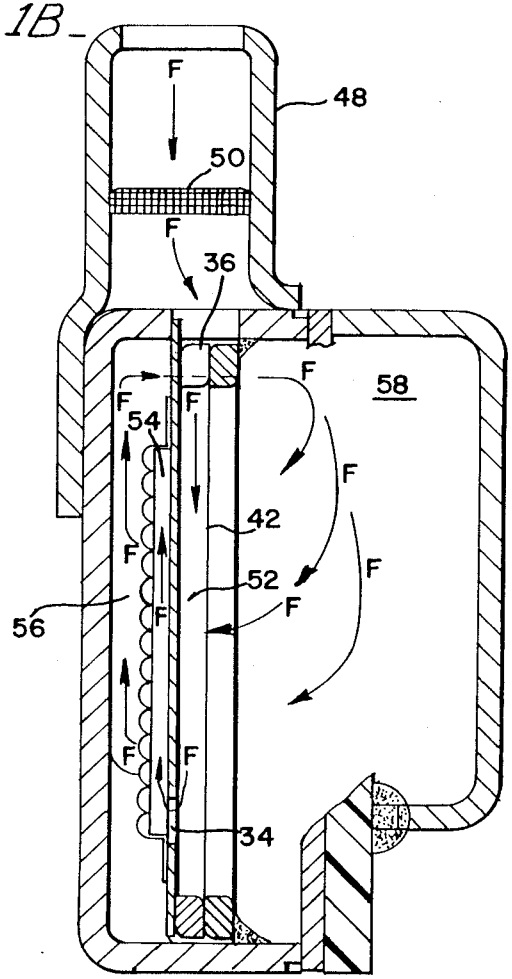
FIG. 1B is a cut-away side view similar to FIG. 1A, but having components not directly associated with the acoustical paths of the microphone assembly removed, and further showing these paths by directional arrows.

While this invention is susceptible of embodiment in many different forms, there is shown in the drawings and will herein be described in detail preferred embodiments of the invention with the understanding that the present disclosure is to be considered as an exemplification of the principles of the invention, and is not intended to limit the broad aspect of the invention to embodiment illustrated.

Referring now to the figures, the structure of the microphone assembly 10 of the present invention comprises a case or housing 12, which, in the embodiment shown is square in shape and has depending walls 14. A plate 16 supports a circuit board 18. An electrical amplifier (not shown) is constructed on this board 18, which carries terminals 26 connected to the amplifier to protrude to the outside.

Figure 3:
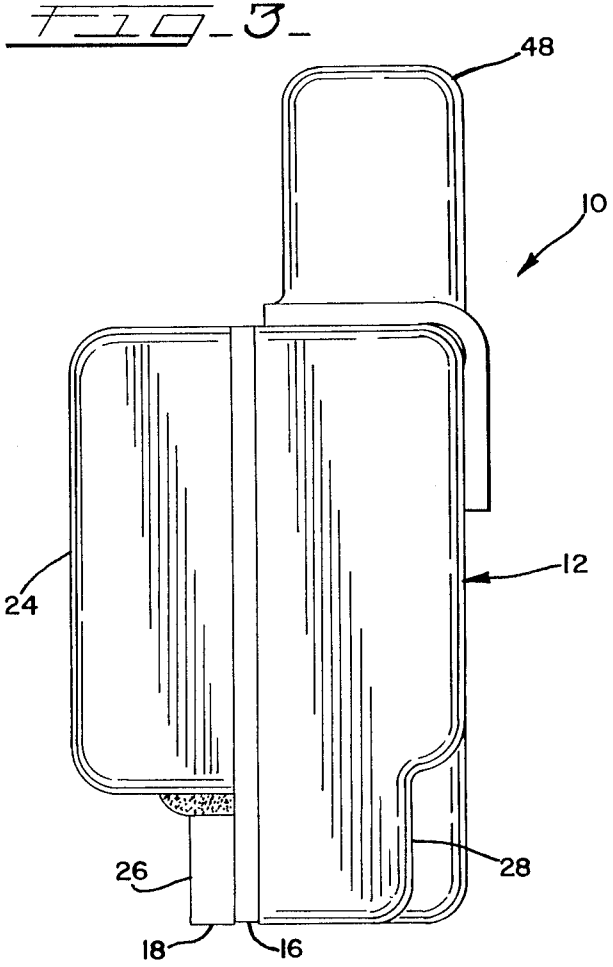
FIG. 3 is a side view of the microphone assembly shown in FIG. 1A, but viewed from the opposite side.

Two of the corners 28 of the main housing 12 are deformed to act as supports of predefined height (see FIG. 3). Two corners of a special labyrinth plate 30 rest on these supports. The opposite end of this plate 30 has a protrusion which extends into a case inlet 36, thereby forming a three point support. This labyrinth plate 30 generally divides the case into two isolated volumes sealed off from each other except for special acoustical passages, one of which is a hole 34 through the labyrinth plate and disposed generally diametrically opposite the sound inlet 36. An annularly disposed ring 33 glued to the right-hand face of the labyrinth plate 30 as seen in FIG. 1A acts as a spacer for subsequent assembly. This ring 33 has a section removed so as not to impede the flow of sound entering the case inlet 36.

On the left-hand face of the labyrinth plate 30 there is mounted a generally circular cup-shaped secondary diaphragm 38 similar in shape to those proposed in the previously mentioned Killion patent. The distance between the secondary diaphragm 38 and the labyrinth plate 30 is restricted so as to play a role in the overall frequency response of the microphone assembly. An annular flange portion 40 of the secondary diaphragm 38 is glued to the left-hand face of the labyrinth board 30 as shown in FIG. 1A. The secondary diaphragm 38 thus stands at a small distance from the labyrinth plate 30 to form a generally sealed volume therein, except for the acoustical passage.

A main diaphragm assembly consisting of a compliant conducting main diaphragm 42 peripherally attached to mounting ring 44 is affixed to the housing interior by glue fillets 46 to be held in a position where the main diaphragm 42 confrontingly contacts the spacing ring 33. The glue fillets 46 and that portion of the main diaphragm mounting ring 44 in the vicinity of the inlet passage 36 effectively seal off the interior structure of the microphone assembly to the right of the main diaphragm from the inlet passage 36. An electret assembly 49 is mounted (by means not shown) to the mounting ring 44 so as to be in contacting engagement at peripheral portions with the main diaphragm 42.

Figure 1A:
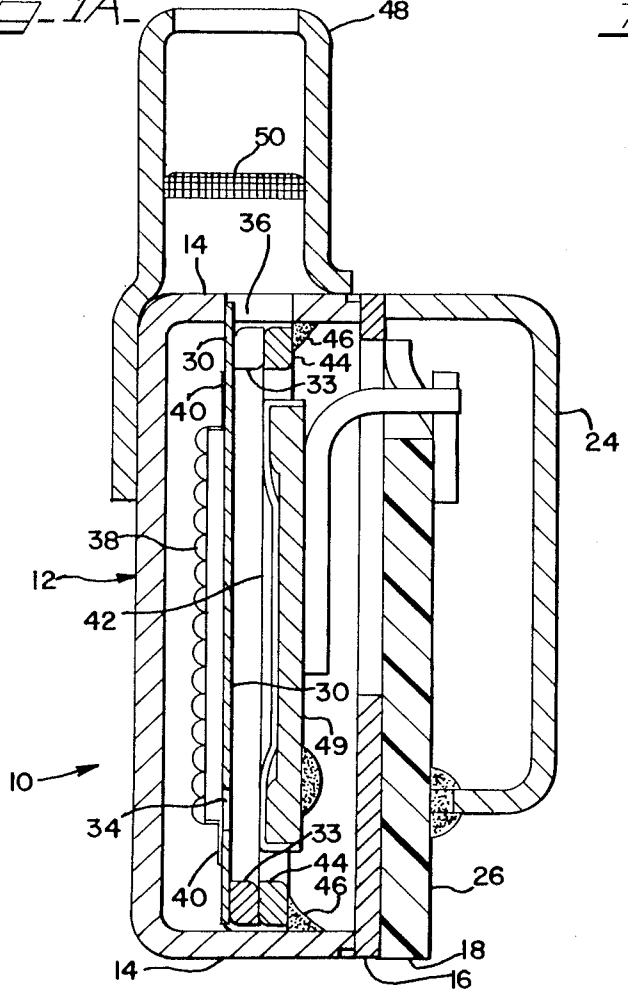
FIG. 1A is a cross-sectional side view of the microphone assembly of the present invention.
Figure 2:
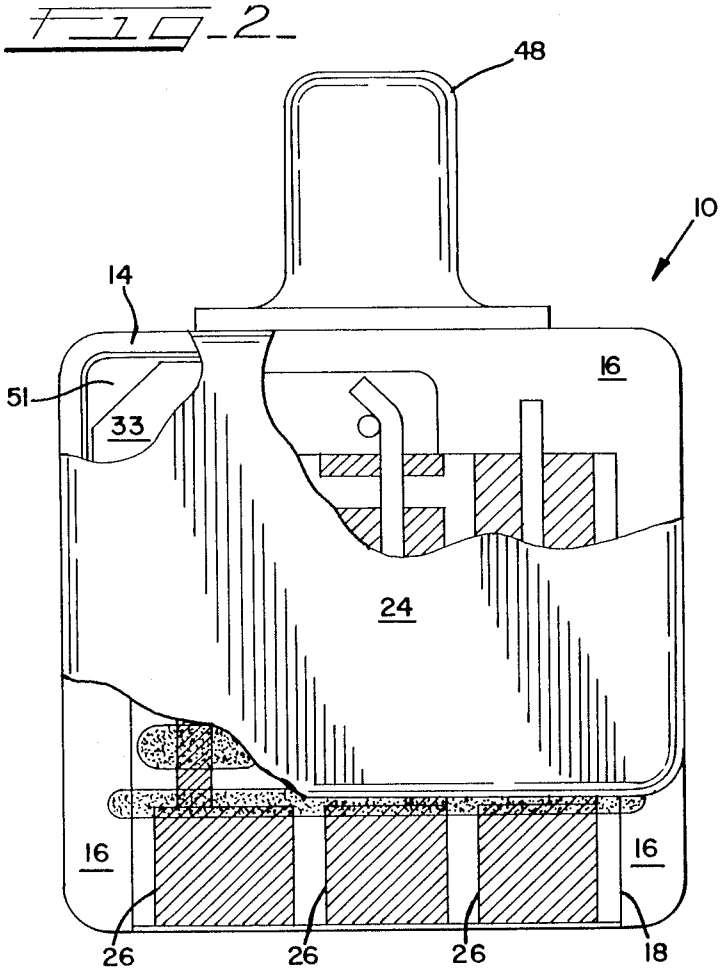
FIG. 2 is a partially cutaway plan view of the microphone assembly shown in FIG. 1A.

Referring now to FIG. 1A, FIG. 1B and FIG. 2 it will be seen that sound (indicated by flow arrows F-F) entering through an inlet tube 48 passes through a damping element or filter 50 to provide an inertance and a resistance to the incoming sound, the sound thereafter entering the inlet port 36. Thereafter the incoming sound travels across the chamber 52 (excitation chamber) formed by the main diaphragm 42 and the labyrinth plate 30, thereby providing energization of the main diaphragm 42. Thereafter the sound passes through the small aperture 34 in the labyrinth plate 30 to enter the chamber 54 (transfer chamber) formed between the secondary diaphragm 38 and the labyrinth plate. Excitation of this secondary diaphragm 38 causes sound to be transmitted to the remaining volume 56 defined by the interior surface of the case 12, the secondary diaphragm 38 and the labyrinth plate 30.

Sound received in this chamber is then coupled across through a bypass port 51 (FIG. 2) to enter the volume 58 in the housing lying to the right of the main diaphragm 42 so as to impinge on the rear surface of the main diaphragm 42. This bypass port 51 is made by cutting away a corner of the labyrinth board 30, the diaphragm mounting ring 44 and the spacing ring 33 in the vicinity of one corner of the housing, as shown FIG. 2. As a result, this bypass port 51 transmits sound received from the secondary diaphragm 38 around to the rear (right-hand) surface of the main diaphragm 42.

The dimensions of the various channels, apertures, and ports, the compliances of the two diaphragms 42, 38, the acoustical transmission properties of the damping element 50, and the relative volumes of the various chambers are arranged so that at low frequencies a substantial replication of the pressure excitation delivered to the main diaphragm 42 from the incoming sound is provided via the bypass port 51 to the rear surface of the main diaphragm, thereby materially reducing the excitation pressure in such lower frequency ranges. By this means the microphone is rendered relatively unresponsive to low frequency sound. At higher frequencies, however, significant attenuation of this feed-around occurs because of the frequency-dependent acoustical attenuating properties of the coupling passages, with the result that at these higher frequencies this pressure cancellation effect is largely lost. As a result of this, at these higher frequencies the microphone sensitivity is materially augmented.

Considering the various acoustical elements in more detail, at low frequencies sound is relatively unimpeded by small clearances, and except for the highly complaint secondary diaphragm 38 would be of essentially equal magnitude on both sides of the transducer diaphragm 42. The secondary diaphragm 38 produces a slight sound pressure imbalance of relatively constant magnitude at low frequencies, which results in a low level signal output from the transducer. At a well controlled intermediate frequency the inertia of the air flowing across the main diaphragm 38 and in the remainder of the sound path through the secondary diaphragm causes a resonant condition which acoustically seals off this path for all higher frequencies. This produces a step in the frequency response pattern similar to that proposed by U.S. Pat. No. 4,450,930; however, the present invention differs in the design of the structure necessary to achieve the same response.

As shown in FIG. 1B, the main transducer diaphragm 42 and labyrinth plate 30 form a small cavity 52 of narrow dimension. Unlike the usual microphone, this cavity does not act as a lumped capacitive element, since the hole 34 in the labyrinth plate 30 allows sound traveling the length of the cavity to exit therethrough. As the height of the cavity is small, there is restriction to sound flow along the length of the cavity, which is also acoustically shunted at each point by a portion of the main diaphragm 42. This cavity thus behaves generally as a distributed transmission line. Sound then enters the even more restricted cavity 54 formed between the labyrinth wall 30 and the secondary diaphragm 38, to exit therefrom with modest attenuation thereafter to travel to the opposite surface of the main diaphragm 42 via the bypass port 51.

At higher frequencies this feed-around action is greatly attenuated, such attenuation arising to a considerable degree because of inertial and resistance effects experienced by sound traveling through restricted passages. Inertial effects arise in general from the necessary pressure differential required to accelerate a column of air confined within an acoustical conduit. Quantitatively this phenomenon is referred to as inertance. The inertance per unit length of a given conduit is proportional to the density of air and inversely proportional to the cross-section area of the conduit. Resistance effects are inherently dissipative, and arise from viscous drag at the walls of the conduit, such drag giving rise to a pressure differential. Clearly, at frequencies sufficiently low that inertance effects in a given conduit may be ignored, resistance effects may still play a role. In general, the resistance per unit length of a given conduit will typically be strongly governed by the minimum dimension thereof, e.g., the separation between the main diaphragm 42 and the labyrinth wall 30, and the separation between the secondary diaphragm 38 and the labyrinth wall.

Although the actual equivalent circuit of the microphone assembly 10 is quite complex, certain general observations may nevertheless be made. The first is that the turnover frequency, i.e., the frequency at which the compensating sound pressure that is fed around to the rear of the main diaphragm 42 begins to be severely attenuated, is strongly governed by the product of the compliance of the secondary diaphragm 38 and the effective inertance of the acoustical passages supplying sound energy to it. To a first approximation this inertance may be taken to be the effective inertance of the lower half of the input chamber 52, the inertance of the labyrinth plate port 34, and the inertance of the lower half of the secondary diaphragm cavity 54. The amount of attenuation at frequencies well above the turnover point will also be governed by resistances of the various relevant conduits and ports, as well as the acoustical damper 50.

It is clear that additional resistance and inertance effects may be provided by similarly adjusting the separation between the interior wall of the casing 12 and the secondary diaphragm 38. The labyrinth plate 30 may be eliminated, and the secondary diaphragm 38 may be moved correspondingly closer to the main diaphragm 42; however, the turnover frequency rises as a result of this. By using such a labyrinth plate 30 to add significantly to the acoustical path length, sufficient inertance is provided to achieve the desired stepped frequency response turnover at approximately 1 kilohertz in a reduced dimension microphone assembly, in accordance with a design objective of the instant invention. In the event, that for one reason or another, a significantly higher turnover frequency is desired, then the labyrinth plate 30 may, as mentioned above, be eliminated. Alternatively, multiple labyrinth plates may be employed to increase the labyrinth inertance and/or resistance, if desired.

The response of the microphone assembly described hereinabove is generally stepped, and similar to that of the microphone assembly described in the previously mentioned Killion patent. It has a turnover frequency of approximately 1 kilohertz, rising thereafter by a factor of approximately 20 d.b. at a value of 3 kilohertz. This behavior is, however, achieved in a structure substantially smaller than the Killion structure, for reasons outlined hereinabove. The case dimensions (exclusive of the inlet tube 38) of the assembly shown in the figures are approximately 3.6 by 3.6 by 2.3 millimeters.

I claim:

1. A frequency-compensated hearing aid microphone assembly for providing from incoming ambient sound a frequency-varying differential actuating pressure to a transducer-operating diaphragm comprising:

a housing having a main chamber therein;

a compliant first diaphragm disposed to divide the interior of said main chamber into a first chamber on a first side of said first diaphragm and a second chamber on a second side of said first diaphragm opposite said first side;

transducing means coupled to said first diaphragm for producing an electrical signal responsive to movement of said first diaphragm;

a compliant second diaphragm disposed to divide said first chamber into a transfer chamber and an excitation chamber and disposed in a generally confronting parallel relationship to said first diaphragm;

input port means configured to deliver incoming ambient sound to said excitation chamber at a peripheral region joining said diaphragms to confine entering sound to pass between said diaphragms and parallel thereto, so that inertance presented to sound passing across said diaphragms and the compliance of said first diaphragm form an acoustical distributed line to cause sound intensity transferred to said transfer chamber to vary with frequency; and bypass port means for transferring to said second chamber sound delivered to said transfer chamber through said second diaphragm to provide a sound intensity against said second side of said first diaphragm which varies with frequency.

2. The microphone assembly of claim 1 wherein said first and second diaphragms are configured to form opposing major walls of said excitation chamber.

3. The microphone assembly of claim 2 further including barrier wall means disposed generally parallel to said major walls to divide said excitation chamber into a plurality of acoustical chambers including an input chamber having said first diaphragm as one wall thereof and an output chamber having said second diaphragm as one wall thereof, said input port means being configured to deliver said ambient sound initially to said input chamber, and wall port means serially acoustically coupling said plurality of acoustical chambers together and disposed to cause at least one reversal of the direction of sound travel across said barrier wall means in propagating from said input port means to said second diaphragm.

4. The microphone assembly of claim 3 wherein said input port means is configured to deliver said ambient sound to said input chamber at a first point proximate to an edge of said first diaphragm.

5. The microphone assembly of claim 4 wherein said wall port means includes a first wall port disposed at a second point generally diametrically opposite to said first point and communicating between said input chamber and the next of said plurality of acoustical chambers so that the flow of sound from said input port means to said first wall port is confined by said first diaphragm and said barrier wall means to flow generally across said first diaphragm.

6. The microphone assembly of claim 5 wherein said barrier wall means is configured to divide said excitation chamber into only said input and output chambers.

7. The microphone assembly of claims 1, 2, 3, 4, 5, or 6 wherein said input port means includes acoustical damping means disposed to present an acoustical resistance to the transmission of ambient sound to said first diaphragm.

8. The microphone assembly of claims 1, 2, 3, 4, 5, or 6 wherein said transducing means is disposed within said second chamber.

* * * * *